United States Patent [19]

Pristelski

[11] 4,048,962

[45] Sept. 20, 1977

[54] WATER TANK HEATED BY SMOKE FROM A FURNACE

[76] Inventor: Stanley Pristelski, Rte. 1, Box 132c, Marinette, Wis. 54143

[21] Appl. No.: 684,793

[22] Filed: May 10, 1976

[51] Int. Cl.[2] ..... F22B 33/00; F22D 1/02

[52] U.S. Cl. ..... 122/20 B; 122/421; 126/31

[58] Field of Search ..... 122/13, 20 B, 412, 421; 126/31

[56] References Cited

U.S. PATENT DOCUMENTS

| | | | |
|---|---|---|---|
| 836,770 | 11/1906 | LaBarr | 122/13 |
| 1,668,577 | 5/1928 | Vecchio | 122/20 B |
| 2,080,229 | 5/1937 | Ray | 122/20 B |
| 2,620,431 | 12/1952 | Shepheard | 122/20 B |
| 2,920,608 | 1/1960 | Orban | 122/20 B |

*Primary Examiner*—Kenneth W. Sprague
*Attorney, Agent, or Firm*—McWilliams & Mann

[57] ABSTRACT

Apparatus interposed in a smoke flue between a furnace and a chimney for recovering energy from smoke and heating water therewith. A tank contains a volume of water to be heated. A water inlet and a water outlet supply cold water to the tank and discharge heated water. A plurality of heat exchanging tubes extends through the interior of the tank such that the ends communicate with opposite exterior surfaces of the tank or extend outwardly therefrom. A plurality of sleeves, one for each tube, has an outside diameter slightly less than the inside diameter of the tubes such that each sleeve is positioned within one of the tubes in concentric manner and sealed to the ends of the tube to define an annular air space there-between. Expanding and reducing elements provide gaseous communication between the flue and the plurality of sleeves. The sum of the cross-sectional areas of the plurality of sleeves equals or exceeds the cross-sectional area of the smoke flue such that normal convection of smoke within the flue is not restricted. The sleeves have a plurality of small apertures therethrough, thereby permitting limited gaseous communication with the annular air space for greater heat exchanging efficiency. A by-pass flue, first normally-open damper in the smoke flue between the expanding element and the by-pass flue and a second normally-closed damper in the by-pass flue change positions and divert smoke through the by-pass flue when the water in the tank is heated to a predetermined temperature.

8 Claims, 6 Drawing Figures

WATER TANK HEATED BY SMOKE FROM A FURNACE

BACKGROUND OF THE INVENTION

This invention relates in general to apparatus for heating water with smoke from a furnace, and more particularly to apparatus for recovering some of the energy from the smoke from a furnace wherein the smoke passes through heat exchanging means of a double concentric pipe configuration within the tank.

Various types of devices for recovering some of the heat or energy from smoke, and heating water therewith, are known to the prior art. Some prior art efforts have concentrated on recovering energy in and from the chimney. Such efforts have not proven successful for a number of reasons. Oftentimes the apparatus inserted into the chimney restricts a major portion thereof such that normal convection of the smoke up the chimney is interfered with. Adapting the chimney for recovery of energy therefrom is usually only practicable when the building, including the chimney, are being constructed. Furthermore, once the apparatus is installed in the chimney, any repair of the apparatus, as may be needed, becomes quite difficult and costly because of the difficulty in gaining access to the apparatus within the chimney.

Other prior art efforts have concentrated upon placing coils or jackets into or around the smoke flue to heat water contained within the coil or jacket. These prior art efforts have also been generally unsuccessful. The volume of water contained by such coils or jackets has generally been insufficient to either supply heated water in desired volume or to achieve efficient transfer of energy between the smoke and the water.

A further problem characteristic of all the prior art is that the coils, jackets and the like, which are used in the smoke flue or chimney experience moisture condensation on the surfaces thereof when exposed to the smoke. This moisture condensation results from the coils, water jackets and the like having a considerable temperature differential as compared to the temperature of the smoke. Any moisture condensation of the apparatus within the smoke flue or chimney immediately attracts soot and ash generated by the smoke source which results in the apparatus becoming coated with soot and ash. The soot and ash accummulations on the apparatus may become great enough to hamper normal convection of smoke within the flue or chimney. In any event, the heat exchanging efficiency between the apparatus and the smoke quickly deteriorates as soot and ash accummulate on the apparatus.

SUMMARY OF THE INVENTION

The apparatus of the present invention is interposed in the smoke flue between the chimney and the furnace. This location of the apparatus facilitates relatively simple installation, even in the smoke flues of existing structures.

The apparatus includes a tank for containing a volume of water to be heated and a water inlet and a water outlet for supplying water to the tank for discharging water therefrom. Smoke from the flue is routed through the heat exchanging means of the apparatus. The heat exchanging means includes a plurality of heat exchanging tubes of sufficient length that the ends thereof communicate with opposite exterior surfaces of the tank or the ends may extend outwardly therefrom. A plurality of sleeves, one for each of the tubes, has an outside diameter slightly less than the inside diameter of the tubes such that each of the sleeves is positionable within one of the tubes in a concentric manner. Each of the sleeves is sealed to the ends of the tube thereby defining an annular air space between each of the tubes and the sleeves. The annular air space prevents direct contact between the smoke and the tubes which are in contact with the water in the tank, thereby avoiding moisture condensation within the sleeve due to the temperature differential between the smoke and the water. While smoke is passing through the sleeves, the operating temperature of the sleeves will generally be considerably above the operating temperature of the tubes.

The sum of the cross-sectional areas of the sleeves is preferably greater than the cross-sectional areas of the smoke flue. This relationship in cross-sectional areas avoids any restriction in the normal convection of smoke within the flue.

Gaseous communication between the smoke flue and the heat exchanging means within the tank, is provided by an expanding element and a reducing element. The expanding element is located on the furnace side of the apparatus and provides gaseous communication between the smoke flue from the furnace and the plurality of sleeves. The reducing element is positioned on the chimney side of the apparatus and provides gaseous communication between the other ends of the plurality of sleeves and the smoke flue to the chimney.

To avoid excessive overheating of the water within the tank, a by-pass flue may be provided to divert the smoke away from the heat exchanging means of the apparatus when the water within the tank has reached a predetermined temperature. A first normally-open damper is located in the smoke flue between the expanding element and the by-pass flue and the damper is movable between open and closed positions. A second damper is located in the by-pass flue and is normally closed. A linkage means interconnects the first damper and the second damper and an actuator means is adapted for moving the linkage means. The actuator means is responsive to a temperature sensor which is located on the tank to sense the temperature of the water therein. When the temperature in the tank exceeds a predetermined temperature, the actuator means moves the linkage means to cause the first damper to assume a closed position and the second damper to assume an open position. Smoke is then routed through the by-pass flue until such time as the temperature of the water within the tank drops below the predetermined temperature.

During periods when the furnace is not in use, such as during the summer, the apparatus serves as a tempering tank. That is, any cold water admitted in the tank through the water inlet will gradually assume the ambient room temperature.

Various other objects, features and advantages of the invention will become apparent from the following disclosure when taken in conjunction with the drawings.

BRIEF DESCRIPTIONS OF THE DRAWINGS

DESCRIPTION OF THE PREFERRED EMBODIMENTS

Figure 1:
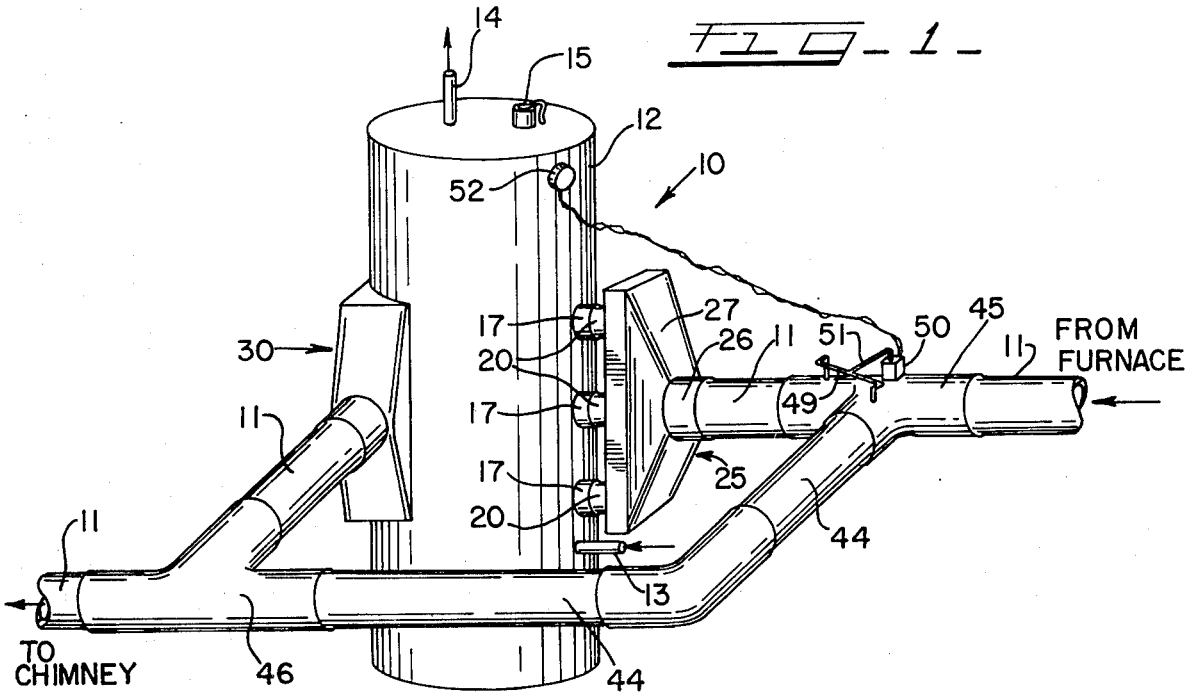
FIG. 1 is a perspective view of the apparatus for recovering energy from a smoke flue according to the present invention.

Turning to FIG. 1, the apparatus, generally designated 10, is shown interposed in a smoke flue 11 between a furnace (not shown) or other smoke generating source and a chimney (not shown). The apparatus 10 is thus in gaseous communication with the smoke and the flue 11.

The apparatus 10 includes a tank 12 for containing a volume of water. However, it is possible that there will be other applications of the apparatus of this invention wherein other liquids besides water may be contained within the tank 12. The tank 12 may be of the standard steel construction, such as those types commonly used in cold water supply systems to provide a pressurized source of water from a water well. For those applications in which the tank 12 is expected to become quite hot, necessitating insulation of the exterior surfaces of the tank 12 to protect persons from burns or to retain heat within the tank 12, the tank 12 may alternatively be insulated such as is done with conventional hot water tanks.

A water inlet 13 permits water to be supplied to the interior of the tank 12. A water outlet facilitates the discharge of heated water from the tank 12. A pressure relief valve 15, a wide variety of which are known to the prior art, is preferably used with the tank 12 to allow water in the tank 12 to discharge in the event that some malfunction causes the tank 12 to become overpressurized.

Figure 3:
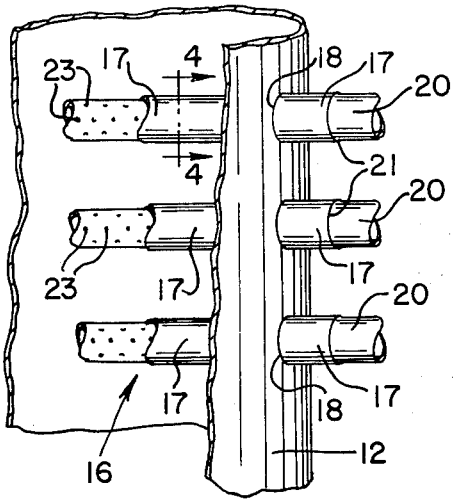
FIG. 3 is a fragmentary, perspective view of the heat exchanging means extending through the interior of the tank, illustrating the plurality of tubes each with a concentric sleeve, which may be perforated, contained within the tubes.

In FIG. 3, there is shown a portion of the tank 12 in a fragmentary, perspective view also illustrating the heat exchanging means, generally designated 16. The heat exchanging means 16 includes a tube 17 extending through the tank 12. The tubes 17 extend at least from one side of the tank 12 to an opposite side thereof. Preferably, the tube 17 extends beyond the opposite exterior surfaces of the tank 12 for a relatively short distance. The tube 17 is sealed to the tank 12 at the apertures 18 in the tank 12, such as by welding or the like. Thus, even though the tube 17 passes through the interior of tank 12, the tank 12 remains suited for containing a volume of water therein.

Figure 4:
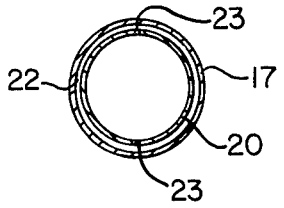
FIG. 4 is a cross-sectional view taken along the sectional line 4—4 of FIG. 3, illustrating the sleeve in concentric relationship to the tube.

According to one aspect of the invention, there is provided a sleeve 20 for insertion into each of the tubes 17. The sleeve 20 has an outside diameter which is slightly less than the inside diameter of the tube 17. This relationship of diameters of the sleeve 20 to the tube 17 permits the sleeve 20 to be inserted concentrically into the tube 17, as illustrated in FIG. 4. The sleeve 20 is sealed to the tube 17 at the ends 21 of the tube 17, as by welding or the like. Extension of the tube 17 somewhat beyond the opposite exterior surfaces of the tank 12 also facilitates the sealing of the tube 17 to the sleeve 20. That is, if the tube 17 terminated flush with the surface of the tank 12, the tube 17 would have to be sealed to the tank 12 at the aperture 18 as well as to the sleeve 20 near the aperture 18. These two separate sealing operations are more easily performed when the tube 17 extends beyond the exterior surface of the tank 12 by one-half inch or more.

Insertion of the sleeve 20 into the tube 17 in the concentric manner illustrated in FIG. 4 results in an annular air space 22 between the tube 17 and the sleeve 20. This structural arrangement permits the sleeve 20 to operate at a temperature near that of the smoke passing therethrough such that undesired moisture condensation on the inside of the sleeve 20 does not occur. Moisture condensation on the inside of the sleeve 20 is undesirable because any moisture will attract soot or ash from the smoke and cause soot or ash deposits to build up on the inside of the sleeve 20. Such deposits are undesirable because soot and ash are not good conductors of heat and result in deterioration of the heat transfer efficiency of the sleeve 20. Furthermore, such deposits may build up to the point that normal smoke convection through the sleeve 20 is restricted.

Unlike the much higher temperature of the sleeve 20, the tube 17 is in direct contact with the volume of water in the tank 12 and the tube 17 therefore operates at a temperature near that of the water contained in the tank 12. The heat transfer between the sleeve 20 to the tube 17 is accomplished both by heat radiation from the sleeve 20 to the tube 17 and by convection of air within the annular air space 22.

It is important to the invention that the sleeve 20 and the tube 17 are not in direct contact with each other within the tank 12. Any such direct contact between the sleeve 20 and the tube 17 would cause cold spots on the sleeve 20 where it contacted tube 17. Such cold spots would result in undesired moisture condensation on the inside of the sleeve 20.

To further increase the heat transfer efficiency between the sleeve 20 and the tube 17, a plurality of small apertures 23 may be provided in the sleeve 20. Since the sleeve 20 may be relatively thin gauge sheet metal, such as that commonly known to the heating and ventilating industry, the apertures 23 may be easily pressed or drilled through the sheet metal. Preferably, the apertures 23 are quite small in diameter, or in area, such that limited gaseous communication is provided between the interior of the sleeve 20 and the annular air space 22. For example, the total area of all of the apertures 23 in the sleeve 20 would preferably be less than five percent of the total cylindrical surface area of the sleeve 20. The relationship between the area of the apertures 23 and the area of the sleeve 20 must be kept small such that large amounts of smoke are not admitted into the annular air space 22. Otherwise, undesirable levels of moisture condensation could occur on the inside of the tube 17 in the annular air space 22 because the operating temperature of the tube 17 will generally be considerably below that of the smoke passing through the sleeve 20.

To achieve optimum heat transfer between the smoke and the water in the tank 12, a plurality of sleeves 20 and tubes 17 are used. Use of a plurality of a heat exchanging means in the tank 12 increases the available surface area of both the sleeves 20 and the tubes 17 and therefore insures that more of the smoke will come into contact with the sleeves 20. The greater surface area provided by a plurality of tubes 17 also exposes more water in the tank 12 to the tubes 17.

It is further desirable to have the sum of the cross-sectional areas of the sleeves 20 to be at least equal in cross-sectional area to that of the smoke flue 11. Such a cross-sectional area relationship tends to avoid any restriction of the natural convection of the smoke through the sleeves 20.

Figure 2:
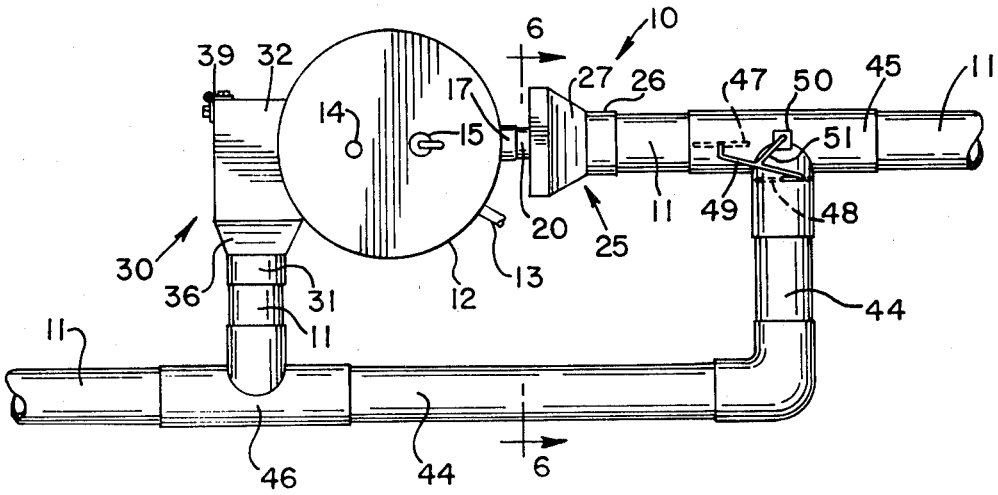
FIG. 2 is a top, plan view of the apparatus illustrated in FIG. 1.
Figure 6:
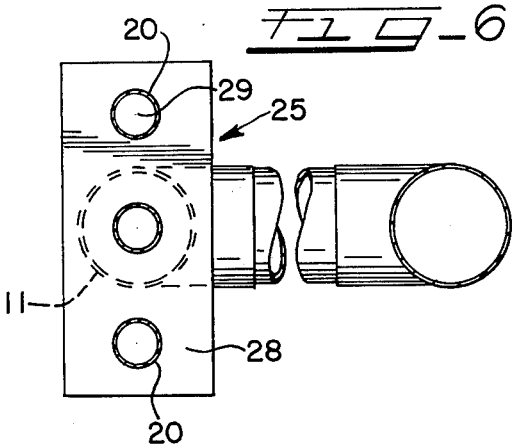
FIG. 6 is a cross-sectional view taken along the sectional line 6—6 of FIG. 2 further illustrating the expanding element and the by-pass flue arrangment.

Gaseous communication between the sleeves 20 and the smoke flue 11 on the furnace side of the tank 12 is effected by an expanding element, generally designated 25 in FIGS. 1 and 2. The expanding element 25 has a cylindrical neck 26 adapted to cooperate and communicate with the smoke flue 11. Extending from the neck 26 is a funnel-shaped portion 27 which expands in cross-section area as the portion 27 leaves the neck 26. The funnel-shaped portion 27 terminates in a rectangular shaped opening at its end opposite to the neck 26. As can be seen in FIG. 6 which illustrates the rectangular end of the expanding element 25, the rectangular end of the funnel-shaped portion 27 is closed by a rectangular sheet 28. The rectangular sheet 28 contains a plurality of apertures 29 at spaced intervals in the sheet 28. The apertures 29 are sized such that the plurality of sleeves 20 fit into and are sealed about the apertures 29.

Figure 5:
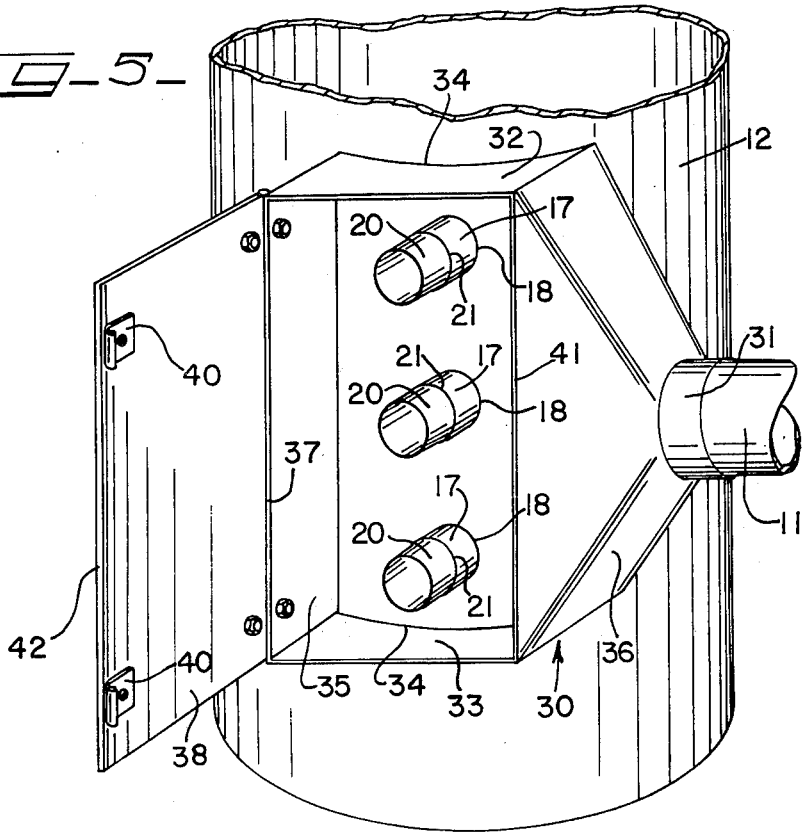
FIG. 5 is a fragmentary, perspective view of the reducing element with the door thereof open for access to the heat exchanging means.

On the opposite or chimney side of the tank 12, a reducing element, generally designated 30, is used to effect gaseous communication between sleeves 20 and the smoke flue 11. The reducing element 30 could be similar to the expanding element 25. However, to better facilitate periodic inspection of the tubes 17 and the sleeves 20, the expanding element 30 preferably has a cylindrical neck 31 at approximately a right angle to the sleeves 20, as shown in FIG. 5. The expanding element 30 consists of a top plate 32 and a bottom plate 33 which are generally rectangular except for one edge 34 of each of the plates 32, 33 being arced to the curvature of the tank 12 with the arced edge welded to the tank 12. A side plate 35 extends between the top plate 34 and the bottom plate 34 and the bottom plate 33. On the side of the reducing element 30 opposite to the side plate 35, a funnel-shaped portion 36 extends between the neck 31, the tank 12, the top plate 34 and the bottom plate 33. Along one vertical edge 37 of the side plate 35, a door 38 is connected thereto by a hinge 39 (FIG. 2). Along an opposite vertical edge 42 of the door 38 are resilient door latches 40. The latches 40 engage a vertical edge 41 of the reducing element 36, thereby normally securing the door 38 in a closed position. A rectangular sheet, such as the sheet 28 used in the expanding element 25 as illustrated in FIG. 6, is not required in the reducing element 30. This is because the reducing element makes use of a portion of the exterior wall of the tank 12 in communicating with the sleeves 20.

In some applications of the apparatus where smoke passing through the smoke flue 11 and the sleeves 20 is nearly continuous and or relatively small amounts are withdrawn from the water outlet 14, it will be appreciated that the temperature within the tank 12 could reach temperatures near the boiling points of water. Such temperatures would cause dangerous pressure conditions within the tank 12. Abnormal pressures could be released by the pressure release valve 15. These dangerous pressure conditions could also be avoided by equipping the apparatus with a by-pass flue 44. The by-pass flue 44 communicates with the smoke flue 11 on the furnace side of the tank 12 by means of a tee 45. The by-pass flue 44 communicates at another end with the smoke flue 11 on the chimney side of the tank 12 by means of another tee 46. A first damper 47 is located in the tee 45 to control passage of smoke through the flue 11 into the expanding element 25, the sleeves 20, the reducing element 30 and then back to the flue 11. The first damper 47 is normally in an open position. A second damper 48 is positioned in a porton of the tee 45 which communicates with the by-pass flue 44. The second damper 48 is normally in a closed position. Mechanical linkage 49 interconnects the first damper 47 and the second damper 48 in their normal positions. An actuation means 50, such as a solenoid, a servomechanism or the like, has an arm 51 connected to the linkage 49. The actuator 50 is responsive to electrical signals from a temperature sensor 52 located on the tank to monitor the temperature of the water in the tank 12. When the water in the tank 12 reaches a predetermined threshold temperature, the sensor 52 causes the actuator 50 to move the arm 51 to pivot the linkage 49. Pivoting of the linkage 49 causes the first damper 47 to assume a closed position and a second damper 48 to assume an open position. The normal path for smoke into the expanding element 25, the sleeves 20, the reducing element 30 and the smoke flue 11 is thereupon blocked. However, smoke through the flue 11 is now able to pass through the by-pass flue 44.

When the temperature of the water within the tank 12 drops below the threshold temperature of the sensor 52, the actuator 50 will cause the first damper 47 and the second damper 48 to again assume their normally open and closed respective positions. Smoke in the flue 11 from the furnace with then resume heating of the water within the tank 12.

Except for the tubes 17 which must be of sufficient strength to withstand water pressures encountered within the tank 12, all of the other duct work of the apparatus including the smoke flue 11, the expanding element 25, the reducing element 30, the sleeves 20, and the by-pass flue 44 can all be fabricated from relatively thin gauge sheet metal such as that generally used in the heating and ventilating industry. Thus, the apparatus disclosed herein can be economically manufactured. The tube 17 can be conventional water pipe. Various grades of pipe, including stainless steel types, could be used depending upon the desired life span of the apparatus.

It will be understood that various changes and modifications can be made without departing from the spirit of the invention as defined in the following claims, and the equivalents thereof.

I claim:

1. Apparatus for recovering energy from a smoke flue of a furnace and for heating water therewith, said apparatus adapted for interposition in said flue between said furnace and a chimney such that said apparatus is in gaseous communication with said flue, said apparatus comprising;

a tank with an interior for containing a volume of water;

a water inlet for providing water to said tank;

a water outlet for removing water from said tank;

heat exchanging means comprising a heat exchanging tube extending through the interior of said tank, said tube having a pair of ends and an outer surface, an inside diameter, and sufficient length that said pair of ends communicate with opposite exterior surfaces of the tank or extend outwardly beyond said surfaces;

a sleeve with an outside diameter slightly smaller than said inside diameter of the tube such that said sleeve is positionable within said tube and is concentric in relation thereto, said sleeve being sealed to said tube at the ends of said tube in a manner exterior to said tank thereby defining an annular air space between said tube and said sleeve, said sleeve adapted to communicate with said smoke flue between said furnace and said chimney with said heat exchanging means transferring some of the heat in the smoke flue to said water thereby heating said water while avoiding moisture condensation and soot build-up in said sleeve.

2. The apparatus as in claim 1 wherein a plurality of small apertures through said sleeve provide limited gaseous communication between an inside of said sleeve and said annular air space between said sleeve and said tube for more efficient heat transfer in said heat exchanging means.

3. Apparatus for recovering energy from a smoke flue of a furnace for heating water therewith, said apparatus adapted for interposition in said flue between said furnace and a chimney such that said apparatus is in gaseous communication with said flue, said apparatus comprising;

a tank with an interior for containing a volume of water;

a water inlet for providing water to said tank;

a water outlet for removing water from said tank;

heat exchanging means comprising a plurality of heat exchanging tubes extending through the interior of said tank, said tubes each having a pair of ends, an outer surface, an inside diameter and sufficient length that said pair of ends communicate with opposite exterior surfaces of the tank or extend outwardly therefrom;

a plurality of sleeves, one for each of said tubes, with an outside diameter slightly smaller than said inside diameter of said tubes such that each of said sleeves is positionable within one of said tubes and is concentric in relation thereto, each of said sleeves being sealed to each of said tubes at the ends of the tubes in a manner exterior to said tank thereby defining an annular air space between each of said tubes and said sleeves;

an expanding element for providing gaseous communication between said smoke flue from said furnace at first ends of said plurality of sleeves; and a reducing element for providing gaseous communication between second ends of said plurality of sleeves and said smoke flue to said chimney.

4. The apparatus as in claim 3 wherein the sum of the cross-sectional areas of said plurality of sleeves equals or exceeds the cross-sectional area of said smoke flue.

5. The apparatus as in claim 4 wherein a plurality of small apertures through said sleeves provide limited gaseous communication between an inside of each of said plurality of sleeves and said annular air space between each of said plurality of sleeves and tubes.

6. The apparatus as in claim 3 wherein at least one of said expanding element or said reducing element is generally perpendicular to the length of said plurality of said sleves, and a door in said generally perpendicular element provides access to said sleeves.

7. The apparatus as in claim 3 further comprising a by-pass flue communicating with said smoke flue near said expanding element at one end, and with said reducing element at another end; and control means responsive to the temperature of the water in the tank to divert smoke from said furnace through the by-pass flue when the water in the tank has been heated to a predetermined temperature.

8. The apparatus as in claim 7 wherein said control means comprises a temperature sensor for sensing the temperature of the water in the tank;

a first damper located in the smoke flue between said expanding element and said by-pass flue, said first damper movable between open and closed positions, with said first damper in a normally open position thereby permitting gaseous communication through said sleeves in the tank;

a second damper located in said by-pass flue, said second damper movable between open and closed positions, with said second damper in a normally closed position thereby blocking gaseous communication through said by-pass flue;

linkage means connecting said first damper and said second damper, said linkage means adapted to move said first damper and said second damper between their respective positions; and actuator means for moving said linkage means, said first damper and said second damper in response to said temperature sensor to direct smoke through said heat exchanging means in said tank when the water temperature therein is below a predetermined temperature and to direct said smoke through said by-pass flue when the water temperature is above said predetermined temperature.

* * * * *